US008265526B2

(12) United States Patent
Kubo et al.

(10) Patent No.: US 8,265,526 B2
(45) Date of Patent: Sep. 11, 2012

(54) DEVELOPER CONTAINER, DEVELOPING APPARATUS, AND IMAGE FORMING APPARATUS

(75) Inventors: Keisuke Kubo, Ebina (JP); Takashi Sakamoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 501 days.

(21) Appl. No.: 12/543,148

(22) Filed: Aug. 18, 2009

(65) Prior Publication Data

US 2010/0247150 A1 Sep. 30, 2010

(30) Foreign Application Priority Data

Mar. 26, 2009 (JP) ..... 2009-076330

(51) Int. Cl.
*G03G 15/08* (2006.01)

(52) U.S. Cl. ..... 399/254

(58) Field of Classification Search ..... 399/254–256, 399/252

See application file for complete search history.

(56) References Cited

U.S. PATENT DOCUMENTS

| | | | | |
|---|---|---|---|---|
| 3,999,514 | A * | 12/1976 | Abbott et al. | 399/256 |
| 5,682,583 | A * | 10/1997 | Ito et al. | 399/254 |
| 2006/0245793 | A1* | 11/2006 | Tatsumi et al. | 399/254 |
| 2007/0127951 | A1* | 6/2007 | Ishikawa et al. | 399/254 |
| 2007/0274741 | A1* | 11/2007 | Shiraishi et al. | 399/254 |
| 2011/0123229 | A1* | 5/2011 | Takashima et al. | 399/254 |

FOREIGN PATENT DOCUMENTS

| | | |
|---|---|---|
| JP | 9-197942 | 7/1997 |
| JP | 2007-65453 A | 3/2007 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

The invention provides a developer container that comprises a container main unit having a partition arranged at a position dividing a first transport space and a second transport space that are spaces in which developer is transported respectively, and an opening, and a lid that blocks the opening, and contacts the partition in a state in which the partition is bent when the opening is blocked, and the lid dividing the first transport space and the second transport space using a portion of the lid, which contacts the partition.

10 Claims, 7 Drawing Sheets

DEVELOPER CONTAINER, DEVELOPING APPARATUS, AND IMAGE FORMING APPARATUS

CROSS-REFERENCE TO RELATED APPLICATIONS

This application is based on and claims priority under 35 USC 119 from Japanese Patent Application No. 2009-076330 filed Mar. 26, 2009.

BACKGROUND

1. Technical Field

The present invention relates to developer containers, developing apparatuses, and image forming apparatuses.

2. Related Art

There are image forming apparatuses that use a developer to develop a latent image formed on a photosensitive member and transfer the image to a recording medium. And there are apparatuses that are known as developing apparatuses used in this type of image forming apparatus in which, for example, partitions are provided that divide the space inside the developer container into multiple transport spaces, with these transport spaces being connected by gaps provided in the partitions, and the developer inside these transport spaces is churned while being transported.

SUMMARY

According to an aspect of the invention, there is provided a developer container comprising a container main unit having a partition arranged at a position dividing a first transport space and a second transport space that are spaces in which developer is transported respectively, and an opening, and a lid that blocks the opening, and contacts the partition in a state in which the partition is bent when the opening is blocked, and the lid dividing the first transport space and the second transport space using a portion of the lid, which contacts the partition.

BRIEF DESCRIPTION OF THE DRAWINGS

An exemplary embodiment of the present invention will be described in detail based on the following figures, wherein.

DETAILED DESCRIPTION

Hereinafter, exemplary embodiments of the present invention are described.

1. Overall Configuration of Image Forming Apparatus

Figure 1:
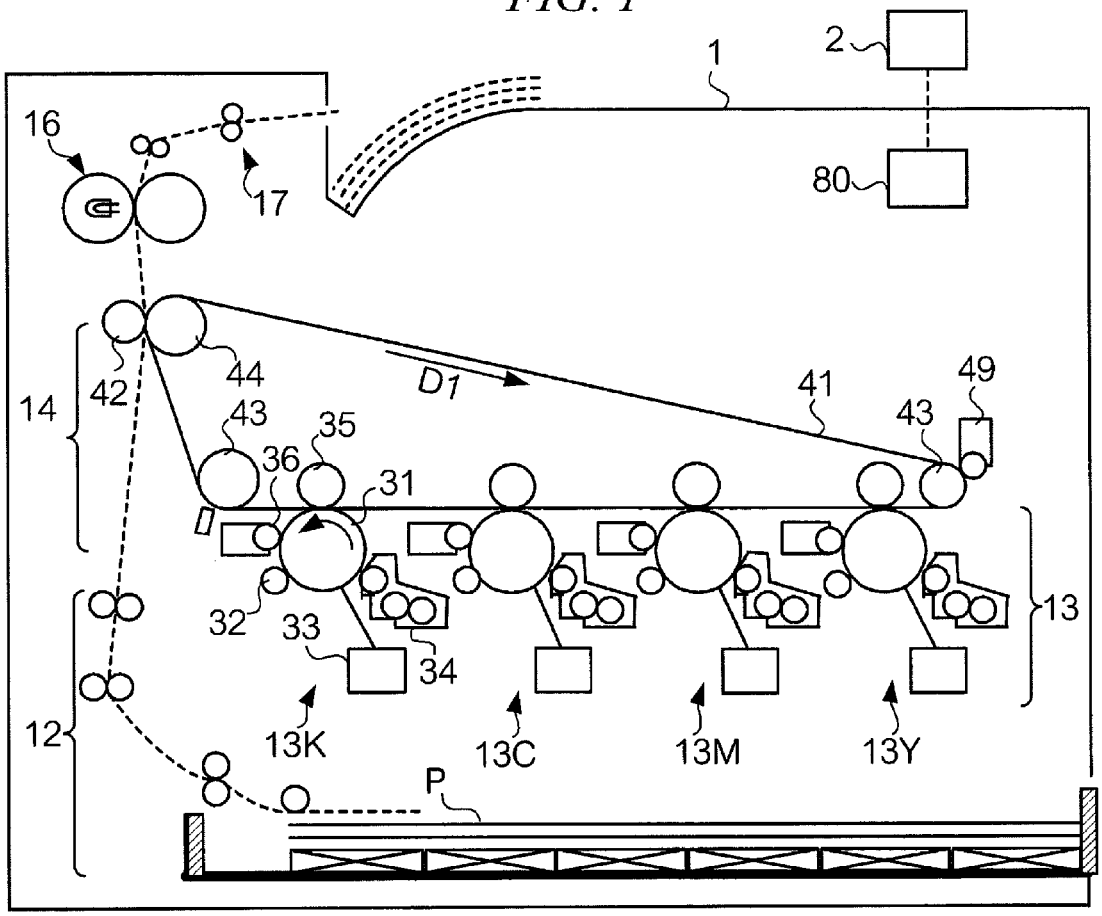
FIG. 1 is a diagram showing an overall configuration of an image forming apparatus according to an exemplary embodiment of the present invention.

FIG. 1 is a diagram showing an overall configuration of an image forming apparatus 1 according to the present exemplary embodiment. As shown in FIG. 1, the image forming apparatus 1 is provided with a recording medium supply portion 12, image forming units 13Y, 13M, 13C, and 13K, a transfer unit 14, a fixing portion 16, a recording medium discharge portion 17, and a control portion 80. The recording medium supply portion 12, image forming units 13Y, 13M, 13C, and 13K, transfer unit 14, fixing portion 16, and recording medium discharge portion 17 are controlled by the control portion 80. It should be noted that the symbols Y, M, C, and K signify constituents corresponding to toners of yellow, magenta, cyan, and black respectively.

The recording medium supply portion 12 accommodates papers P as recording media, which have been cut in advance to a predetermined size. The papers P accommodated in the recording medium supply portion 12 are taken out sheet by sheet according to instructions of the control portion 80 and transported to the transfer unit 14 via a paper transport path. It should be noted that the recording medium is not limited to paper and may be a resin sheet or the like for example.

The image forming units 13Y, 13M, 13C, and 13K use a respectively corresponding color toner to form an image in response to image data of each color respectively, then these are superimposed and transferred onto an intermediate transfer belt 41 of the transfer unit 14. This image data may be data that is generated by reading an original image using an image reading device, which is one example of an external device 2, or may be data that is generated according to data that has been sent from a computer, which is one example of the external device 2. Only the toner used in each of the image forming units 13Y, 13M, 13C, and 13K is different, and there is no major difference in the configuration of the units. Hereinafter, unless there is a particular need to distinguish between the units, the image forming units 13Y, 13M, 13C, and 13K are referred to as "image forming unit 13" omitting the alphabetic suffix of the symbol that indicates the color of the toner.

Figure 2:
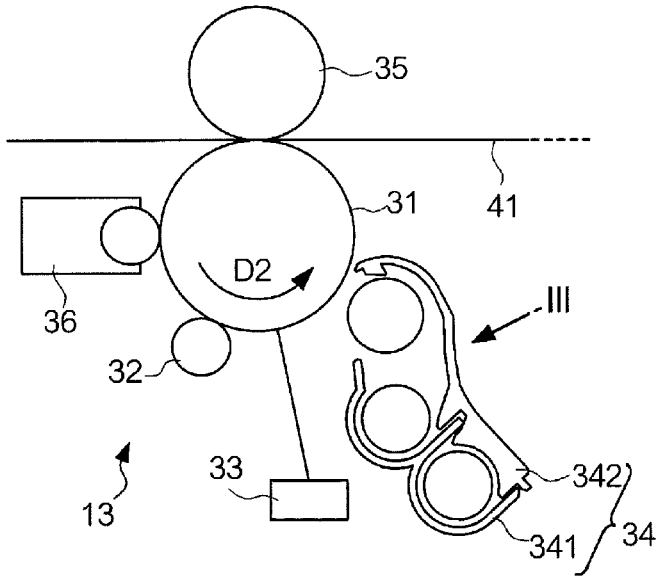
FIG. 2 is a diagram showing an enlargement of one of the image forming units provided in the image forming apparatus.

FIG. 2 is a diagram showing an enlargement of one of the image forming units 13 shown in FIG. 1. As shown in FIG. 2, the image forming unit 13 is provided with a photosensitive drum 31, which is one example of a latent image carrier, a charger 32, an exposure device 33, a developing device 34, a primary transfer roller 35, and a drum cleaner 36. The photosensitive drum 31 is one example of an image carrier that carries an image, has a charge producing layer and a charge conveying layer, and is rotated in a direction shown in the diagram by an arrow D2 by an unshown drive portion. The charger 32 charges a surface of the photosensitive drum 31. The exposure device 33 is provided with a laser light emitting source and polygon mirrors and the like (none of which is shown in the diagram) and carries out exposure by irradiating a laser light corresponding to image data onto the photosensitive drum 31 after the photosensitive drum 31 has been charged by the charger 32.

In a space inside a developer container constituted by a container main unit 341 formed by a synthetic resin of plastic or the like and a lid 342, the developing device 34 accommodates a two-constituent developer, which includes a color toner of one of Y, M, C, or K and a magnetic carrier such as ferrite dust or the like. By bringing a developer roller 341*g* (described later), which is provided in the developing device 34, in close proximity to the surface of the photosensitive drum 31, the toner adheres to a portion, that is, an electrostatic latent image, on the surface of the photosensitive drum 31 that has been exposed by the exposure device 33, and in this way an image is formed on the photosensitive drum 31. A detailed configuration of the developing device 34 is described later.

The primary transfer roller 35 produces a predetermined difference of potential at a position where the intermediate transfer belt 41 of the transfer unit 14 is in opposition to the photosensitive drum 31, and the image is transferred to the intermediate transfer belt 41 due to this difference of potential. The drum cleaner 36 removes untransferred toner, which remains on the surface of the photosensitive drum 31 after transfer of the image, and neutralizes the surface of the photosensitive drum 31.

Description returns again to FIG. 1. The transfer unit 14 is provided with the intermediate transfer belt 41, a secondary transfer roller 42, belt transport rollers 43, and a backup roller 44, and is a transport section that transfers the image formed by the image forming unit 13 onto the paper P. The intermediate transfer belt 41 is an endless belt member, and the belt transport rollers 43 and the backup roller 44 hold the intermediate transfer belt 41 in a tensioned state. A drive portion (not shown in drawings) is provided in at least one among the belt transport rollers 43 and the backup roller 44, and the intermediate transfer belt 41 is caused to rotate in an arrow D1 direction shown in FIG. 1. It should be noted that the belt transport roller(s) 43 or the backup roller 44 that is not provided with a drive portion rotates idly with the movement of the intermediate transfer belt 41. Due to the intermediate transfer belt 41 moving and rotating in the arrow D1 direction shown in FIG. 1, the image transferred by the transfer unit 14 is caused to move to a region where the secondary transfer roller 42 and the backup roller 44 are in contact.

Due to the difference of potential between the intermediate transfer belt 41 and the secondary transfer roller 42, the image on the intermediate transfer belt 41 is transferred to the paper P that has been transported from the recording medium supply portion 12. A belt cleaner 49 removes untransferred toner that resides on the surface of the intermediate transfer belt 41. Then the transfer unit 14 transports the paper P on which the image has been transferred to the fixing portion 16. The fixing portion 16 is provided with a hot roller and a support roller, and the image that has been transferred to the paper P is fixed to the paper P by the heat and pressure applied by using these. The recording medium discharge portion 17 discharges the paper P that has undergone the fixing process by the fixing portion 16 to a paper placement area provided on top of the image forming apparatus 1.

The above-described image forming unit 13 and the transfer unit 14 are a single example of an image forming section.

2. Configuration of Developing Device of Image Forming Unit

2-1. Internal Configuration of Container Main Unit

Figure 3:
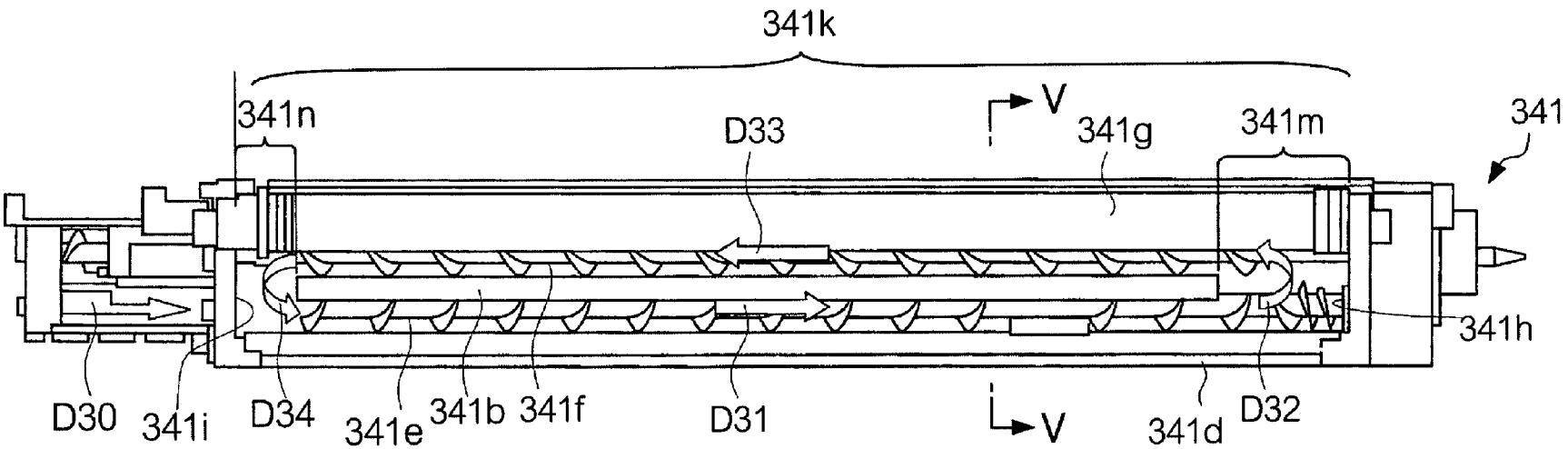
FIG. 3 is a diagram of a container main unit as seen from an arrow III direction in FIG. 2.

FIG. 3 is a top view of the container main unit 341 as seen from an arrow III direction in FIG. 2. An opening 341*k* of the container main unit 341 shown in FIG. 3 is blocked by the lid 342, but the lid is not shown in FIG. 3. Accordingly, FIG. 3 shows a state in which the inside of the container main unit 341 can be seen through the opening 341*k*.

The container main unit 341 has a lengthwise direction that is in a direction parallel to an axial direction of the photosensitive drum 31. Inside the container main unit 341, a partition 341*b* is provided that juts upward from the bottom surface of the container main unit 341 toward the lid 342. Here, bottom surface refers to the surface facing the lid 342 when the opening 341*k* is blocked by the lid 342. The internal space of the container main unit 341 is divided into two transport spaces by the partition 341*b*, namely a first transport space and a second transport space. Of these, the transport space closer to the developer roller is referred to as a supply space, and the transport space farther from the developer roller is referred to as a churning space. Inside the supply space, a supply member 341*f* is provided, which is a transport member on which vanes are arranged in a spiral manner around the shaft, and similarly inside the churning space, a churning member 341*e* is provided, which is a transport member on which vanes are arranged in a spiral manner around the shaft. A gap 341*m* and a gap 341*n* are provided in the partition 341*b* at positions corresponding to the ends of the supply member 341*f* and the churning member 341*e*. The supply space and the churning space are connected by the gaps 341*m* and 341*n*.

For example, when developer is supplied from a toner container referred to as a toner cartridge to the developing device 34, the developer is first transported to the churning space along an arrow D30 direction to the developing device 34 from the left end of the container main unit 341 shown in FIG. 3. The developer is transported in an arrow D31 direction accompanying rotation of the churning member 341*e*, and is further transported to a position of an inner wall 341*h* at an end of the churning space. Then, when the developer comes against the inner wall 341*h*, it moves in an arrow D32 direction, which is a direction leading to the supply space, through the gap 341*m* provided in the partition 341*b*. Then the developer is transported in an arrow D33 direction, which is an opposite direction to the arrow D31 direction, accompanying rotation of the supply member 341*f*. Some of the developer transported by the supply member 341*f* is supplied to the developer roller 341*g*, and the remainder is transported to a position of an inner wall 341*i*. Then, the developer that has come against the inner wall 341*i* moves in an arrow D34 direction, which is a direction leading to the churning space, through the gap 341*n* provided in the partition 341*b*. Then, the developer that has moved in the arrow D34 direction is again transported in the arrow D31 direction by the churning member 341*e* along with developer that is newly supplied from outside to the developing device 34 along the arrow D30 direction. In this manner, a transport route is formed inside the container main unit 341 indicated by the directions D31→D32→D33→D34→D31, and the developer is churned by a process of being circulated on this transport route.

2-2. Relationship Between Container Main Unit and Lid

Figure 4:
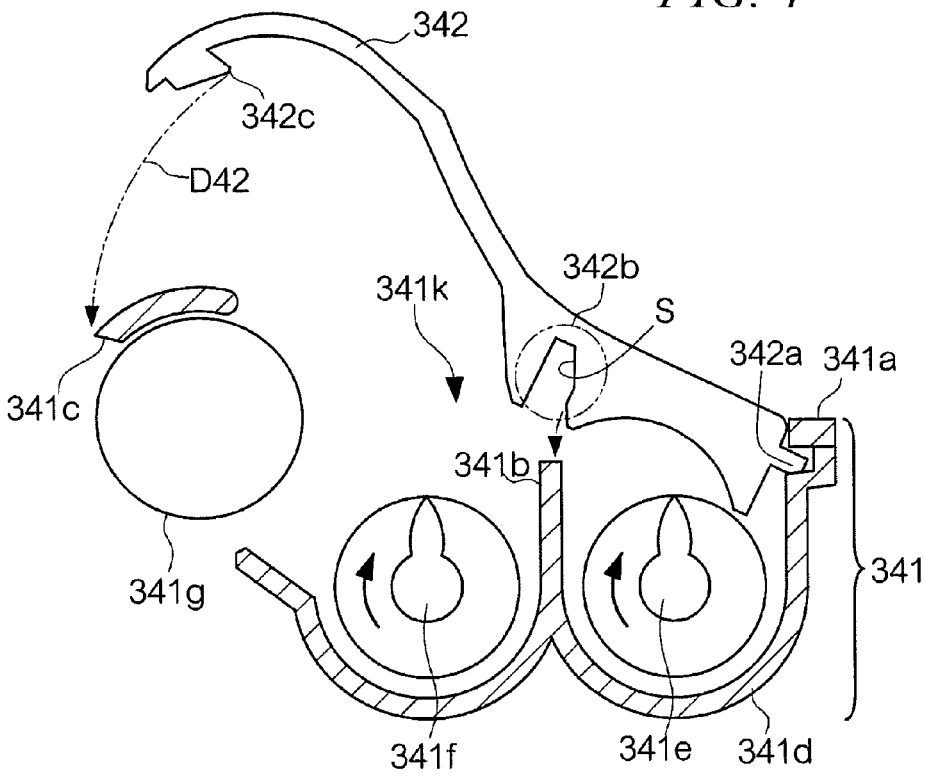
FIG. 4 is a diagram showing a process by which an opening of the container main unit is blocked by a lid.
Figure 5:
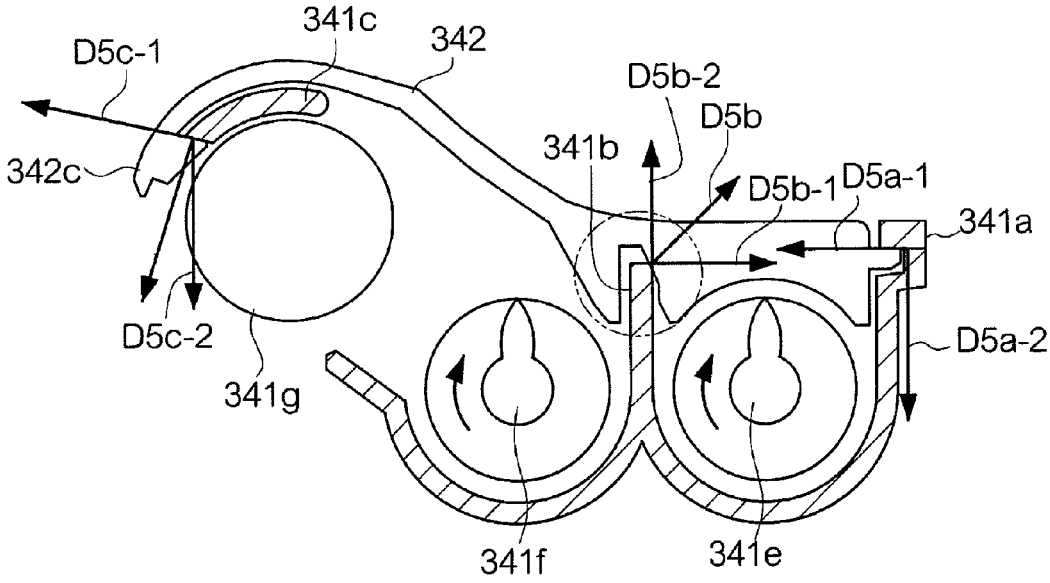
FIG. 5 is a cross-sectional view of the container main unit and lid as seen from an arrow V-V direction in FIG. 3.

FIG. 4 is a cross-sectional view as seen along an arrow V-V direction in FIG. 3 and shows a process in which the opening 341*k* of the container main unit 341 is blocked by the lid 342. Furthermore, FIG. 5 is a cross-sectional view of the container main unit 341 and the lid 342 secured to this as seen from the arrow V-V direction in FIG. 3. Hereinafter, description is given regarding a relationship between the container main unit 341 and the lid 342 with reference to FIG. 4 and FIG. 5.

The lid 342 has a lengthwise direction equivalent to the container main unit 341, and a protruding member 342*a* is provided at an end of one of the long sides thereof, and a hook-shaped member 342*c*, which is bent in a hook shape, is provided at an end of the other long side thereof. Furthermore, an indentation 342*b* is provided on a surface of the lid 342 facing the container main unit 341. FIGS. 4 and 5 show only a cross section of one portion of the lid 342, but the indentation 342*b* is provided contiguously along the lengthwise direction of the lid 342. On the other hand, in regard to the protruding member 342*a* and the hook-shaped member 342*c*, one each of the protruding member 342*a* and the hook-shaped member 342*c* may be provided contiguously along the lengthwise direction of the lid 342, or multiple protruding members 342*a* and hook-shaped members 342*c* may be provided respectively along the lengthwise direction of the lid 342. When the lid 342 blocks the opening 341*k*, the indentation 342*b* is a portion into which an end of the partition 341*b* of the container main unit 341 is inserted. A width of the breadth-wise of the indentation 342*b* is larger than the thickness of the end of the partition 341*b*. The indentation 342*b* has a contact surface S, which is a plane tilted at a prescribed angle to the direction in which the partition 341*b* is inserted. When the lid 342 is blocking the opening 341*k*, the contact surface S contacts the partition 341*b* in a state in which the partition 341*b* is bent.

An indentation 341*a* is provided at an end of one of the long sides of the container main unit 341. The indentation 341*a* is provided at a position corresponding to the protruding member 342*a* of the lid 342, and the protruding member 342*a* inserts into the indentation 341*a* when the lid 342 blocks the opening 341*k*. Furthermore, a hook-receiving member 341*c* having a shape that meshes with the hook-shaped member 342*c* of the lid 342 when the lid 342 blocks the opening 341*k* is provided at an end of the other long side of the container main unit 341.

The developer container of the developing device 34 is configured by a user combining the container main unit 341 and the lid 342 in a following manner.

First, the user brings the end of the lid 342 where the protruding member 342*a* is provided close to the end of the container main unit 341 where the indentation 341*a* is provided, then inserts the protruding member 342*a* of the lid 342 into the indentation 341*a* of the container main unit 341. At this time, the end of the lid 342 where the protruding member 342*a* is provided and the end of the container main unit 341 where the indentation 341*a* is provided make contact, and therefore the user rotates the lid 342 with this contact area as a fulcrum, and brings the hook-shaped member 342*c* of the lid 342 close to the hook-receiving member 341*c* of the container main unit 341 along an arrow D42 direction. Then, after the hook-shaped member 342*c* and the hook-receiving member 341*c* make contact, the hook-shaped member 342*c* and the hook-receiving member 341*c* mesh when the user presses the lid 342 toward the container main unit 341 such that the lid 342 and the container main unit 341 are secured to each other. At this time, the contact surface S provided in the indentation 342*b* of the lid 342 contacts the partition 341*b* of the container main unit 341, and the partition 341*b* is pushed by the contact surface S of the indentation 342*b* into a bent state. In this manner, the opening 341*k* of the container main unit 341 is blocked by the lid 342.

3. Force Produced when Container Main Unit is Blocked by Lid

Figure 6:
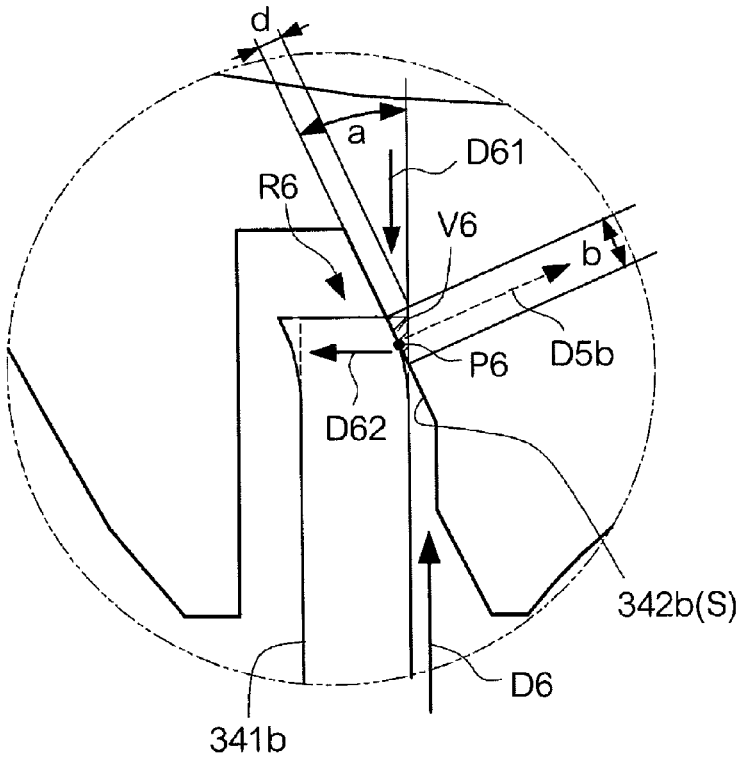
FIG. 6 is a diagram showing an enlargement of an area where a contact surface of an indentation contacts an end of a partition of the container main unit.

FIG. 6 is a diagram showing an enlargement of an area where the contact surface S of the indentation 342*b* contacts the end of the partition 341*b* of the container main unit 341. When the opening 341*k* of the container main unit 341 is blocked by the lid 342, the contact surface S of the lid 342 moves in an arrow D61 direction as shown in FIG. 6. That is, an insertion direction of the partition 341*b* into the indentation 342*b* becomes a direction exactly opposite to the arrow D61, namely, a direction of an arrow D6. As mentioned before, the contact surface S is a plane tilted to the direction in which the partition 341*b* inserts to the indentation 342*b*, and therefore when contact is made with a point P6 for example of the end portion of the partition 341*b*, a force in a direction bending the partition 341*b* in an arrow D62 direction is applied to the partition 341*b*. Due to this, a space V6 where a portion of the end of the partition 341*b* would be present if it were not bent is occupied by the lid 342 as shown in FIG. 6. The partition 341*b* that is bent in the arrow D62 direction in this manner presses back against the contact surface S in an arrow D5*b* direction due to an elasticity of its material.

As shown in FIG. 5, the force of the arrow D5*b* direction is resolved into a force of an arrow D5*b*-1 direction and a force of an arrow D5*b*-2 direction. The end having the protruding member 342*a* of the lid 342 receives the force of the arrow D5*b*-1 direction and comes against an embankment portion of the indentation 341*a* of the container main unit 341 such that it pushes the embankment portion in the arrow D5*b*-1 direction. On the other hand, as a reaction to this, the lid 342 is pushed back by a force from the aforementioned embankment portion of the indentation 341*a* in an arrow D5*a*-1 direction. Furthermore, the lid 342 receives the force from the partition 341*b* in the arrow D5*b*-2 direction, but due to an action of this force, the protruding member 342*a* of the lid 342 is pushed by a force from the indentation 341*a* in an arrow D5*a*-2 direction, which is an opposite direction to the arrow D5*b*-2 direction. Furthermore, due to the force of the arrow D5*c*-1 direction and the force of the arrow D5*c*-2 direction, the area where hook-shaped member 342*c* of the lid 342 and the hook-receiving member 341*c* of the container main unit 341 are meshed receives a force in a direction such that these are tightly meshed together.

It should be noted that in a state in which the container main unit 341 is blocked by the lid 342, an inclination angle a of the contact surface S to the direction at which the partition 341*b* inserts into the indentation 342*b* is 20° for example. A width b of a direction in which the partition 341*b* extends of an area where the contact surface S and the partition 341*b* make contact is 1 mm for example. And a bend amount d of the end of the partition 341*b* in a state in which the container main unit 341 is blocked by the lid 342 is 0.3 mm for example.

When releasing the lid 342 from the container main unit 341, the user first moves the lid 342 in the arrow D5*a*-1 direction of FIG. 5, then causes the partition 341*b* to bend in the arrow D62 direction shown in FIG. 6 and releases the meshing of the hook-shaped member 342*c* and the hook-receiving member 341*c*. Then, when the hook-shaped member 342*c* and the hook-receiving member 341*c* are released, the user releases the lid 342 from the container main unit 341 by moving the end of the partition 341*b* apart from the indentation 342*b* of the lid 342. In other words, the arrow D5*a*-1 direction is a direction in which the lid 342 itself is caused to move when releasing the lid 342 from the opening 341*k*. In a state in which the opening 341*k* is blocked by the lid 342, the lid 342 receives a force in an opposite direction to the arrow D5*a*-1 direction. That is, the lid 342 receives a force of an opposite direction to the direction in which it must move when it is to be released from the opening 341*k*. Accordingly, compared to a case where the partition 341*b* does not press the contact surface S in the arrow D5*b* direction, it becomes more difficult for the lid 342 to come off from the container main unit 341.

By an action of the force by which the container main unit 341 and the lid 342 press against each other in this manner, the crevice between contact surface S of the indentation 342*b* and the partition 341*b* becomes narrower. Accordingly, the amount of developer that passes through the crevice, that is, that moves over the partition to move between the supply space and the churning space is reduced. Furthermore, since the contact surface S is a plane tilted to the direction in which the partition 341*b* inserts to the indentation 342*b*, the partition 341*b* bends more for deeper insertions of the end of the partition 341*b* into the indentation 342*b*. Accordingly, even if there is some degree of manufacturing error when manufacturing the container main unit 341 and the lid 342, this error can be assimilated by adjusting the depth by which the partition 341*b* is inserted into the indentation 342*b* such that an increased manufacturing tolerance is achieved.

4. Behavior of Developer Inside Developing Device

Figure 11:
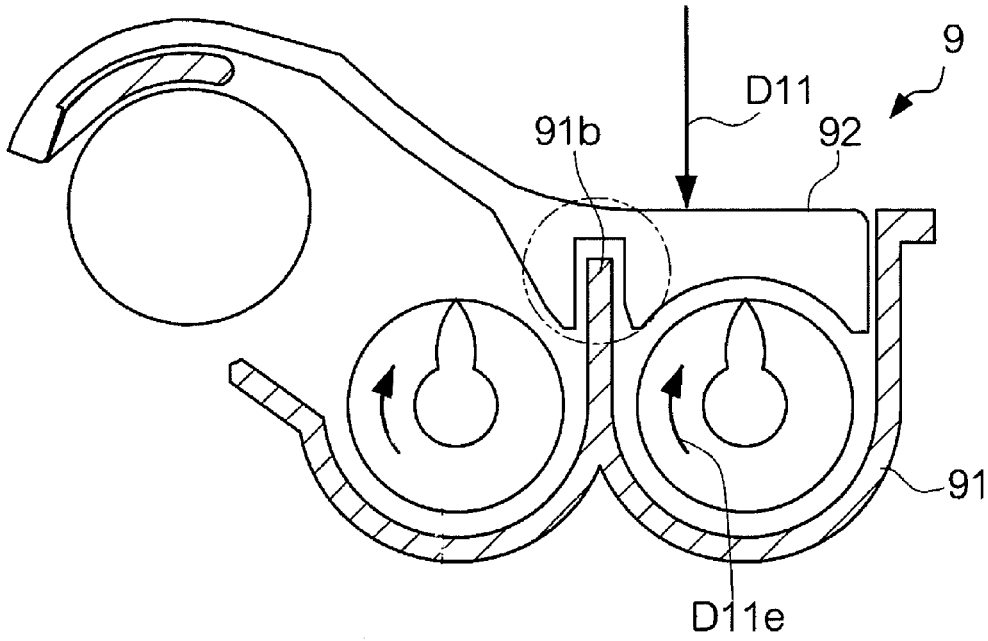
PRIOR ART FIG. 11
FIG. 11 shows a configuration of a conventional developing device.
Figure 12:
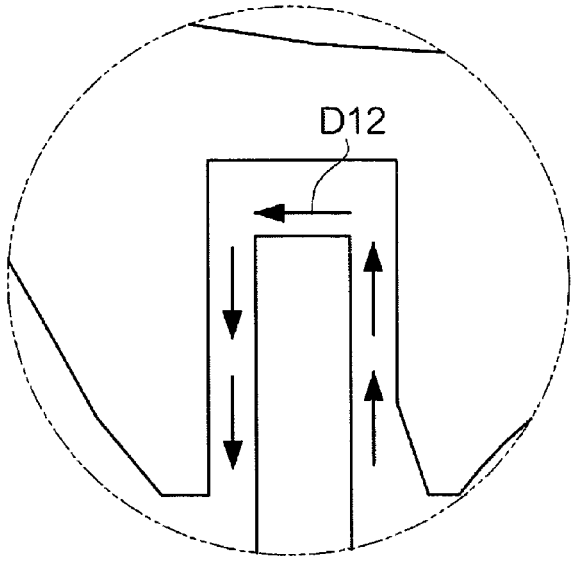
PRIOR ART FIG. 12
FIG. 12 is a diagram showing an enlargement of a vicinity of an end of a partition in the conventional developing device.

FIG. 11 shows a configuration of a conventional developing device 9. And FIG. 12 is a diagram showing an enlargement of a vicinity of an end of a partition 91*b* in FIG. 11. The developing device 9 is configured such that an opening of a container main unit 91 is blocked by a lid 92. The lid 92 is moved in an arrow D11 direction shown in FIG. 11 to be fitted onto the container main unit 91, and therefore the partition 91*b* that divides the churning space and the supply space in the container main unit 91 either has a region that does not make contact with the lid 92 or if it does make contact it is not bent by the lid 92. For this reason, a crevice is produced between the partition 91*b* and the lid 92, and the developer in the churning space sometimes moves in an arrow D12 direction as shown in FIG. 12 accompanying rotation of the churning member. In particular, since the churning member rotates in an arrow D11*e* direction in FIG. 11, the developer that is pushed up by the rotation of the churning member from the bottom of the churning space reaches the crevice between the partition 91*b* and the lid 92, and sometimes moves over this partition to flow into the supply space.

On the other hand, in the aforementioned developing device 34, a behavior of the developer is as follows.

Figure 7:
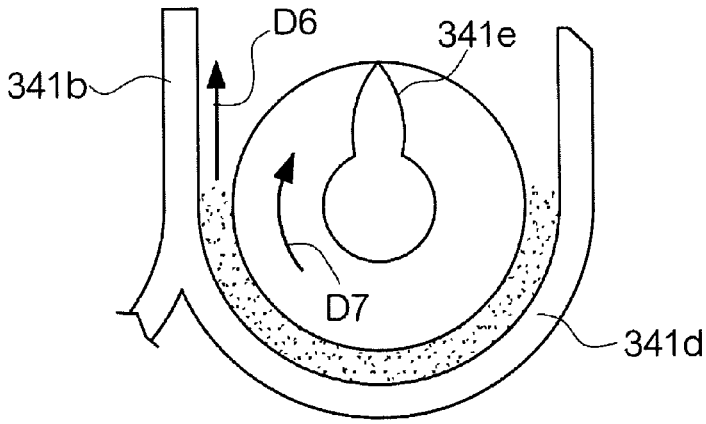
FIG. 7 is a diagram showing a rotation direction of a churning member in a churning space.

FIG. 7 is a diagram showing a rotation direction of the churning member 341*e* in the churning space. As shown in FIG. 7, the churning member 341*e* rotates in an arrow D7 direction. Thus, due to the winding direction of the spiral vanes arranged on the churning member 341*e*, the developer in the churning space is transported in an inward direction in FIG. 7, that is, in the arrow D31 direction in FIG. 3. At this time, some of the developer is pushed up in an arrow D6 direction accompanying rotation in the arrow D7 direction and is moved toward the end of the partition 341*b*.

Here, since the partition 341*b* and the contact surface S make contact at the point P6 as shown in FIG. 6 and are pushed in opposite directions to each other, the crevice between these is smaller than conventionally, and it becomes more difficult for the developer that has moved in the arrow D6 direction to pass through between the partition 341*b* and the contact surface S to move into the supply space.

5. Modified Examples

The foregoing described an exemplary embodiment of the present invention but the content of this exemplary embodiment can be modified in a following manner. Also, the following modified examples may be combined.

5-1. In the above-described exemplary embodiment, first the protruding member 342*a* of the lid 342 comes against the indentation 341*a* of the container main unit 341, after which the hook-shaped member 342*c* of the lid 342 meshes with the hook-receiving member 341*c* of the container main unit 341, but this order may be reversed.

Figure 8:
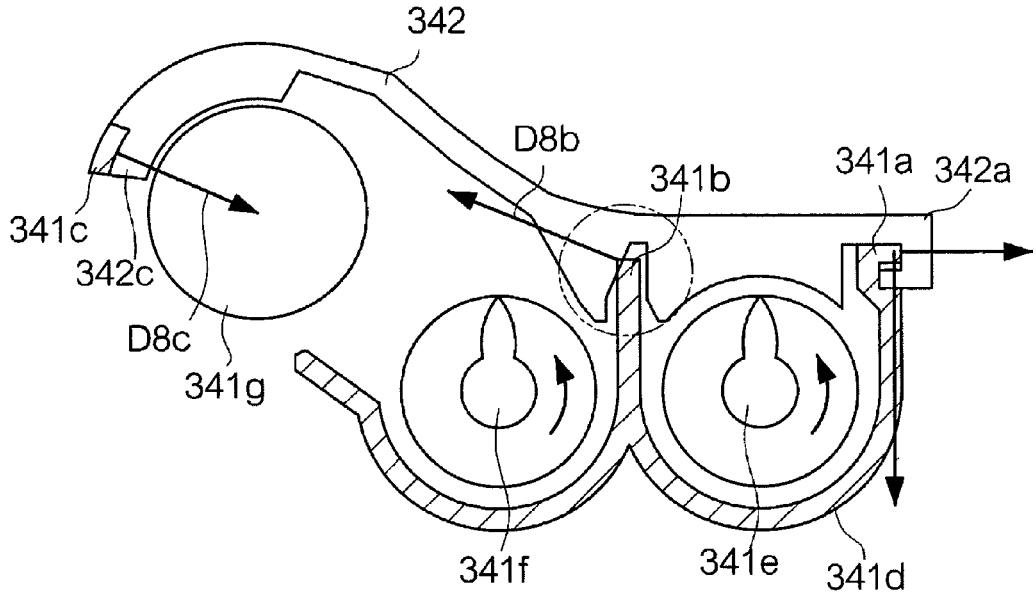
FIG. 8 is a diagram for describing a developing device according to a modified example.

FIG. 8 is a diagram for describing a developing device 34 according to the present modified example. In this modified example, of the opening area of the container main unit 341, the hook-shaped member 342*c* of the lid 342 is first touched against the hook-receiving member 341*c* provided at an end on the developer roller 341*g* side. Then, the lid 342 rotates with this touched-against area as the fulcrum such that the protruding member 342*a* on the opposite side from the hook-shaped member 342*c* meshes with the indentation 341*a* provided at the end on the churning member 341*e* side of the opening area of the container main unit 341. Due to this, the opening of the container main unit 341 is blocked by the lid 342 that has meshed.

Figure 9:
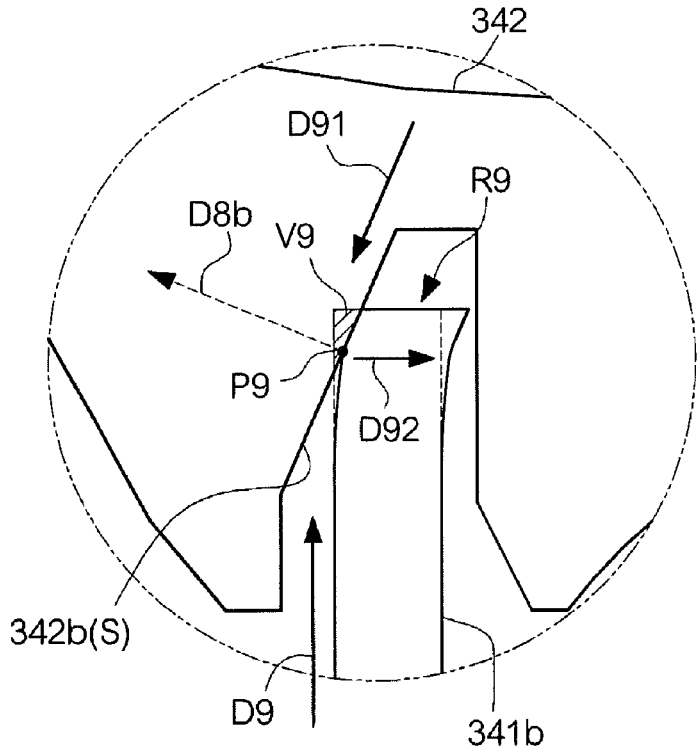
FIG. 9 is a diagram showing an enlargement of an area where a contact surface of a lid contacts an end of a partition of the container main unit.

FIG. 9 is a diagram showing an enlargement of an area where the contact surface S of the indentation 342*b* in FIG. 8 contacts the end of the partition 341*b* of the container main unit 341. When the container main unit 341 is blocked by the lid 342, the contact surface S of the lid 342 moves in an arrow D91 direction as shown in FIG. 9. That is, an insertion direction of the partition 341*b* into the indentation 342*b* becomes a direction opposite to the arrow D91, namely, a direction of an arrow D9. As mentioned before, the contact surface S is a plane tilted to the direction in which the partition 341*b* inserts to the indentation 342*b*, and therefore a space V9 where a portion of the end of the partition 341*b* should be present is occupied by the lid 342. The partition 341*b* that is bent in the arrow D92 direction in this manner presses back against the contact surface S in an arrow D8*b* direction due to an elasticity of its material.

As shown in FIG. 8, an arrow D8*b* direction, which is a direction in which the bent partition 341*b* pushes the contact surface S, has a direction component that is opposite to an arrow D8*c*, which is a direction in which the hook-receiving member 341*c* of the container main unit 341 pushes the hook-shaped member 342*c* of the lid 342. Thus, these forces are in balance with each other and the lid 342 is secured to the opening of the container main unit 341.

When releasing the lid 342 from the container main unit 341, the user first moves the lid 342 in an arrow D8*c* direction of FIG. 8 such that the partition 341*b* is further bent in the arrow D92 direction shown in FIG. 9 and releases the meshing of the protruding member 342*a* and the indentation 341*a*. Then, when the protruding member 342*a* and the indentation 341*a* are released, the lid 342 is released from the container main unit 341 by moving the end of the partition 341*b* apart from the indentation 342*b* of the lid 342. In other words, the arrow D8*c* direction is a direction in which the lid 342 is caused to move when releasing the lid 342 from the opening.

Figure 10:
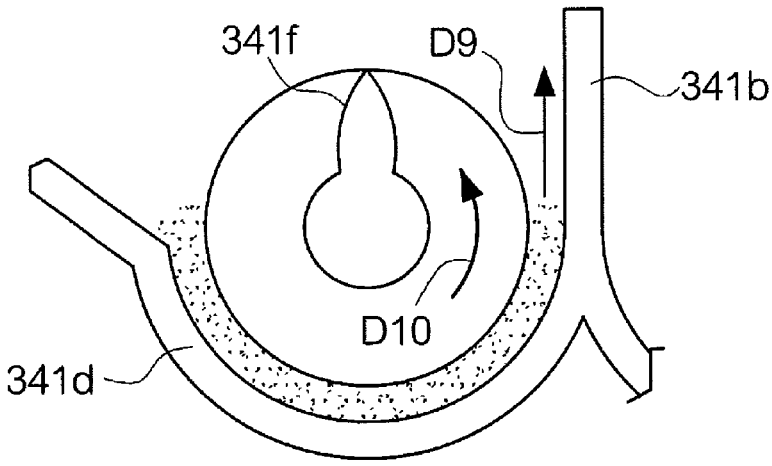
FIG. 10 is a diagram showing a rotation direction of a supply member in a supply space.

FIG. 10 is a diagram showing a rotation direction of the supply member 341*f* in the supply space. As shown in FIG. 10, the supply member 341*f* rotates in an arrow D10 direction. Thus, due to the winding direction of the spiral vanes arranged on the supply member 341*f*, the developer in the supply space is transported in a frontward direction in FIG. 7, that is, in the arrow D33 direction in FIG. 3. At this time, some of the developer is pushed up in an arrow D9 direction accompanying rotation in the arrow D10 direction and is moved toward the end of the partition 341*b*.

Here, since the partition 341*b* and the contact surface S make contact at a point P9 as shown in FIG. 9 and are pushed in opposite directions to each other, the crevice between these becomes smaller. Accordingly, the amount of developer that passes through the crevice, that is, that moves over the partition to move between the supply space and the churning space is reduced. Furthermore, since the contact surface S is a plane tilted to the direction in which the partition 341*b* inserts to the indentation 342*b*, the partition 341*b* bends more for deeper insertions of the end of the partition 341*b* into the indentation 342*b*. Accordingly, even if there is some degree of manufacturing error when manufacturing the container main unit 341 and the lid 342, this error can be assimilated by adjusting the depth by which the partition 341*b* is inserted into the indentation 342*b* such that an increased manufacturing tolerance is achieved.

5-2. The rotation directions of the churning member 341*e* and the supply member 341*f* are not limited to the foregoing directions. In this case, the developer sometimes moves to the region R6 shown in FIG. 6 and the region R9 shown in FIG. 9, but since the partition 341*b* and the contact surface S receive opposite direction forces to contact against each other at the point P6 for the former and the point P9 for the latter, the amount of developer that passes through the crevice between the partition 341*b* and the contact surface S, that is, that moves over the partition to move between the supply space and the churning space, is reduced.

5-3. In the foregoing exemplary embodiment, the contact surface S was a plane tilted with respect to the direction in which the partition 341*b* is inserted to the indentation 342*b*, but the contact surface S is not necessarily a plane. For example, a surface that contacts the partition 341*b* may be a convex curved surface.

Figure 13A:
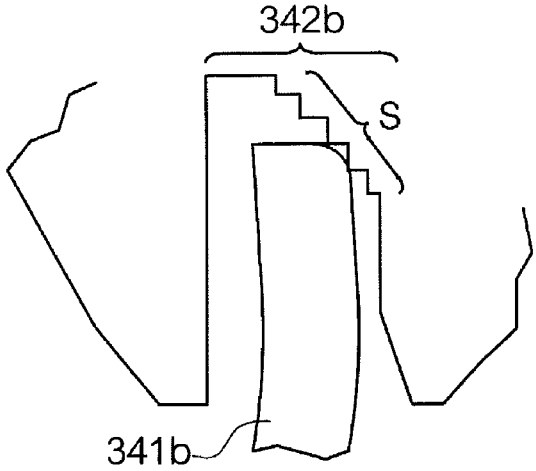
FIG. 13 is a diagram showing one example of a contact surface in a modified example.
Figure 13B:
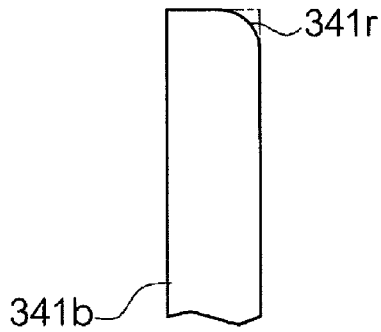

Furthermore, the inclination angle between the contact surface S and the direction in which the partition 341*b* is inserted may be 0°. For example, the contact surface S may be configured as multiple surfaces having an inclination angle of 0° to the direction in which the partition 341*b* is inserted lined up in a step shape. FIG. 13A is a diagram showing one example of a contact surface S in this modified example. In this case, as shown in FIG. 13B, a curved surface 341*r* of the end of the partition 341*b* is provided on a side contacting the contact surface S, and the curved surface 341*r* may be set so as to move along the contact surface S, which is configured in a step shape, when the lid 342 is to block the opening of the container main unit 341.

That is, the contact surface S is not necessarily tilted with respect to the direction in which the partition 341*b* is inserted to the indentation 342*b*. In short, the contact surface S may be any shape as long as it bends the partition 341*b* when in contact with it in a state in which the container main unit 341 is blocked by the lid 342.

5-4. In the foregoing exemplary embodiment, the direction in which the bent partition 341*b* pushes the contact surface S has a direction component that is opposite to the direction in which the lid 342 moves when released from the container main unit 341, but there is no limitation to this. For example, in a case where the lid 342 is released by enabling it to be removed from the container main unit 341 by sliding the lid 342 with respect to the container main unit 341 in the arrow D31 direction or the arrow D33 direction shown in FIG. 3, the direction in which the bent partition 341*b* pushes the contact surface S does not have a direction component of a opposite direction to which the lid 342 moves when released from the container main unit 341. In this case also, the direction in which the bent partition 341*b* pushes the contact surface S has a direction component that is opposite to the direction of the force received from container main unit 341 by the lid 342, and therefore the lid 342 is secured to the opening of the container main unit 341.

5-5. In the foregoing exemplary embodiment, in a state in which the container main unit 341 is blocked by the lid 342, the inclination angle a of the contact surface S to the direction in which the partition 341*b* extends prior to being bent was 20°, but the inclination angle a is not limited to this. In short, as long as a normal vector by which it extends toward the container main unit 341 from the contact surface S has a direction component of a direction in which the lid 342 moves when released, the inclination angle of the contact surface S may be any angle.

5-6. It should be noted that the portion into which the protruding member 342*a* is fitted into is not limited to an indentation, and may be a pass-through hole that passes through a casing 341*d*. Furthermore, it is also possible to provide a protruding member in the casing 341*d* for example, such that the protruding member fits into an indentation or pass-through hole provided in the lid 342. That is, a structure by which the lid 342 is secured to the container main unit 341 is not limited to the content of the exemplary embodiment.

Furthermore, in the above-described exemplary embodiments, an electrographic system printer (image forming apparatus) provided with a so-called tandem engine in which an intermediate transfer belt and an image forming engine are arranged in a series is described as an example, but the present invention is not limited to this mode.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container, comprising:

a container main unit having a partition arranged at a position dividing a first transport space and a second transport space that are spaces in which developer is transported respectively, and an opening; and a lid that blocks the opening, and contacts the partition in a state in which the partition is elastically bent when the opening is blocked, the lid dividing the first transport space and the second transport space using a portion of the lid, which contacts the partition, wherein a force generated when the partition is elastically bent tightens the lid onto the container main unit.

2. The developer container according to claim 1, wherein the lid comprises an engaging portion that is engaged with the container main unit when the lid blocks the opening, and a direction of the force applied to the lid from the bent partition has a direction component that is opposite to a direction in which the lid is moved when the engaging portion is to be disengaged from the container main unit.

3. The developer container according to claim 1, wherein the lid comprises an indentation into which an end of the partition is inserted and makes contact with the lid, and the indentation comprises a surface that causes the partition to bend more for deeper insertions of the end of the partition into the lid.

4. The developer container according to claim 3, wherein a normal vector that extends toward the container main unit from the surface has a direction component that is opposite to a direction in which the lid is moved when the lid is to be released from the opening.

5. The developer container according to claim 1, wherein the lid comprises an indentation into which an end of the partition is inserted and makes contact with the lid, and the indentation comprises a surface that inclines with respect to a direction in which the partition is inserted, and the surface contacts the partition in a state in which the partition is bent when the opening is blocked.

6. The developer container according to claim 5, wherein a normal vector that extends toward the container main unit from the surface has a direction component that is opposite to a direction in which the lid is moved when the lid is to be released from the opening.

7. The developer container according to claim 1, wherein the container main unit comprises a contacting portion, the lid being nipped between the contacting portion and the partition when the opening is blocked.

8. A developing apparatus, comprising:

a developer container comprising a container main unit having a partition arranged at a position dividing a first transport space and a second transport space that are spaces in which developer is transported respectively, and an opening, and a lid that blocks the opening, and contacts the partition in a state in which the partition is elastically bent when the opening is blocked, the lid dividing the first transport space and the second transport space using a portion of the lid, which contacts the partition, wherein a force generated when the partition is elastically bent tightens the lid onto the container main unit.

a transport member that transports developer in each of a first transport space and a second transport space provided in the developer container; and a developing member that faces either the first transport space or the second transport space, and carries out developing by supplying developer supplied from the facing transport space to a latent image carrier that carries a latent image.

9. An image forming apparatus, comprising:

a latent image carrier that carries a latent image;

a charging section that charges the latent image carrier;

a developing apparatus that carries out developing by supplying developer to the latent image carrier charged by the charging section, the developing apparatus comprising a developer container comprising: a container main unit having a partition arranged at a position dividing a first transport space and a second transport space that are spaces in which developer is transported respectively, and an opening, and a lid that blocks the opening, and contacts the partition in a state in which the partition is elastically bent when the opening is blocked, the lid dividing the first transport space and the second transport space using a portion of the lid, which contacts the partition, wherein a force generated when the partition is elastically bent tightens the lid onto the container main unit, a transport member that transports developer in each of a first transport space and a second transport space provided in the developer container, and a developing member that faces either the first transport space or the second transport space, and carries out developing by supplying developer supplied from the facing transport space to a latent image carrier that carries a latent image; and an image forming section that forms an image by transferring developer supplied by the developing apparatus to a recording medium.

10. A developer container, comprising:

a container main unit comprising a partition arranged at a position dividing a first transport space and a second transport space that are spaced in which the developer is transported respectively, and opening; and a lid that blocks the opening, the lid comprising a groove in which a portion of the partition is inserted, and an engaging portion, which is engaged with the container main unit when the lid blocks the opening, wherein the partition is elastically bent into contact with the groove.

* * * * *